US006366253B1

(12) United States Patent
Hemmingsen, II

(10) Patent No.: US 6,366,253 B1
(45) Date of Patent: Apr. 2, 2002

(54) SATELLITE ANTENNA ALIGNMENT DEVICE

(76) Inventor: Robert J. Hemmingsen, II, 500 Wendy Heights Rd., Council Bluffs, IA (US) 51503

( * ) Notice: Subject to any disclaimer, the term of this patent is extended or adjusted under 35 U.S.C. 154(b) by 0 days.

(21) Appl. No.: 09/668,596

(22) Filed: Sep. 22, 2000

(51) Int. Cl.[7] ..... H01Q 3/00
(52) U.S. Cl. ..... 343/760; 343/882; 343/894
(58) Field of Search ..... 343/760, 894, 343/878, 882, 840

(56) References Cited

U.S. PATENT DOCUMENTS

| | | | | |
|---|---|---|---|---|
| 2,064,236 | A | 12/1936 | Willis | 33/1 |
| 2,085,059 | A | 6/1937 | Woodside | 33/76 |
| 2,698,902 | A | 1/1955 | Farrow, Jr. et al. | 250/33.65 |
| 2,926,842 | A | 3/1960 | Ackerman | 235/61 |
| 3,816,000 | A | 6/1974 | Fiedler | 356/152 |
| 4,095,342 | A | 6/1978 | Oertli | 33/1 SD |
| 4,175,330 | A | 11/1979 | Hermann | 33/27 C |
| 4,422,738 | A | 12/1983 | Steele | 353/11 |
| 4,754,947 | A | 7/1988 | Propp | 248/544 |
| 4,771,548 | A | 9/1988 | Donnery | 33/512 |
| 4,866,852 | A | 9/1989 | Plier | 33/431 |
| 5,007,320 | A | 4/1991 | Craig et al. | 83/745 |
| 5,103,569 | A | 4/1992 | Leatherwood | 33/379 |
| 5,734,356 | A | 3/1998 | Chang | 343/882 |
| 5,977,922 | A | 11/1999 | Hemmingsen, II | 343/760 |
| 6,081,240 | A | 6/2000 | Hemmingsen, II | 343/760 |
| 6,160,520 | A | * 12/2000 | Muhlhauser et al. | 343/755 |

OTHER PUBLICATIONS

Parts Express Catalog "Satellite Finder Kit", p. 13.
MCM Electronics Catalog 35 "Satellite Finder Kit", p. 246.
DBL Distributing, Inc. Catalog "Monster Cable Digital Satellite Finder", p. 10.
Petra Catalog "Perfect 10 Satellite Finder", p. 7, and "Monster Cable Monster Satellite Digital Satellite Finder", p. 10.

* cited by examiner

*Primary Examiner*—Don Wong
*Assistant Examiner*—Hoang Nguyen
(74) *Attorney, Agent, or Firm*—Zarley, McKee, Thomte, Voorhees & Sease; Dennis L. Thomte

(57) ABSTRACT

A satellite antenna alignment device is provided which includes a support which may be selectively removably mounted on the underside of the support arm of the antenna. The alignment device includes a pivotal plumb bob having a chart positioned therebelow which is provided with skew angles and elevation angles to enable the antenna to be quickly and easily elevated to the proper elevation and skewed to the proper skew angle.

12 Claims, 5 Drawing Sheets

SATELLITE ANTENNA ALIGNMENT DEVICE

BACKGROUND OF THE INVENTION

1. Field of the Invention

This invention relates to a satellite antenna alignment device and more particularly to an alignment device which enables a satellite antenna to be aligned with respect to a pair of satellites to enable the satellite antenna to properly receive the signals from both of the satellites.

2. Description of the Related Art

Satellite antennas are frequently used by owners of television sets to receive the signals from a particular satellite. In recent years, the small satellite antennas have become increasingly popular. Many different companies provide satellite television services such as DISH Network™, PRIMESTAR™, DIRECT TV™, etc. In most cases, each of the companies utilizes a particular satellite to transmit signals to their customers. In order for the satellite antennas to receive the signals from the satellite, it is necessary that the antenna be properly aligned with respect to the associated satellite. Generally, the satellite antennas have a low noise block amplifier with integrated feed (LNBF) mounted on the end of a support arm so that the antenna dish will collect and focus the satellite signal onto the LNBF. Frequently, the manufacturer of satellite antennas will provide alignment information to the installers with that information being related to particular zip codes. For example, if a satellite antenna is going to be used with the DISH Network™ and is going to be used in zip code 68118, the manufacturer will advise the installer that the dish of the antenna must be directed or aimed along compass heading or azimuth 207 degrees and must be elevated upwardly from the horizontal 37 degrees.

Electronic devices have been provided for use in aligning satellite antennas which measure the strength of the satellite signals. However, it is necessary for the antenna to be generally aligned with the satellite before those electronic devices will function properly. The alignment of the satellite antennas frequently requires that at least two people be involved and the same is costly and time-consuming. In most satellite antennas, when viewed from the top or bottom thereof, i.e., a vertical plane, the LNBF support arm extends transversely from the dish. Thus, if the dish is aligned or aimed along a particular compass heading, the LNBF support arm will also extend along that same compass heading, but will not point directly at the satellite, since it does not extend from the dish at a right angle when viewed from the side. Normally, when viewed from the side, the plane of the dish and the LNBF support arm form an acute angle. In other words, the dish may be elevated 37 degrees from the horizon but the support arm may be elevated 44 degrees or so, depending upon the particular antenna.

In some cases, the installer attempts to manually align the antenna along the proper compass heading by holding a compass some distance below or above the support arm and then attempts to align the support arm along the proper compass heading. This procedure is crude, at best, and the metal construction of the support arm frequently interferes with the normal operation of the compass. Further, it is extremely difficult for the installer to elevate the dish to the proper elevation, after being directed along the proper azimuth, so that the antenna will be properly aligned.

In an effort to solve the problems of the prior art enumerated above, applicant previously invented a satellite antenna alignment device which is the subject of U.S. Pat. Nos. 6,081,240 and 5,977,922. Although the device of the previously identified patents works extremely well when the antenna is being aligned with a single satellite, certain satellite antennas are now designed to receive signals from the satellites positioned at 110 degrees west longitude and 119 degrees west longitude. In those antennas designed to receive signals from two satellites, the antenna must have a pair of low noise block amplifiers with integrated feed (LNBF) which are mounted on the end of an elongated support arm. The inner end of the elongated support arm is normally secured to a dish mounting bracket which is selectively movably mounted on a skew scale. The skew scale is mounted on a mast clamp which is secured to the upper end of a mast clamp. The mast clamp may be pivotally moved with respect to the mast to change the elevation of the antenna. The skew plate and dish mounting bracket may be rotated with respect to the mast so that the azimuth (direction) of the antenna may be changed. Further, the dish mounting bracket may be rotatably moved with respect to the skew plate to rotate the dish or antenna. Although the conventional satellite antennas which are used to receive signals from a pair of satellites include elevation and skew scales provided thereon, those scales are not completely accurate. Further, for the elevation and skew angles to be accurate, the upper end of the mast must be perfectly plumbed in a vertical condition. If the upper end of the mast is not perfectly plumb, the elevation and skew angles scales will be dramatically inaccurate.

SUMMARY OF THE INVENTION

An alignment device is provided for a satellite antenna which is adapted to receive signals from two different satellites. The antenna includes a mast assembly, a support arm extending outwardly and upwardly from the mast assembly with a pair of LNBFs mounted on the outer end thereof, and a dish operatively secured to the support arm for movement therewith. The antenna alignment device of this invention is operatively removably secured to the amplifier support arm and includes a plumb bob which is positioned above a chart which indicates elevation and skew angles. The chart is somewhat parabolically-shaped so that the lower end of the plumb bob will be positioned closely adjacent the upper surface of the chart as the support arm is elevated and skewed. In another embodiment of the invention, the satellite antenna alignment device is placed against the face of a flat dish.

It is therefore a principal object of the invention to provide an improved satellite antenna alignment device.

A further object of the invention is to provide a satellite antenna alignment device which may be used with satellite antennas which receive signals from at least two satellites.

Still another object of the invention is to provide a satellite antenna alignment device which enables the satellite antenna to not only be accurately elevated, but also accurately skewed.

These and other objects will be apparent to those skilled in the art.

DESCRIPTION OF THE PREFERRED EMBODIMENT

Figure 1:
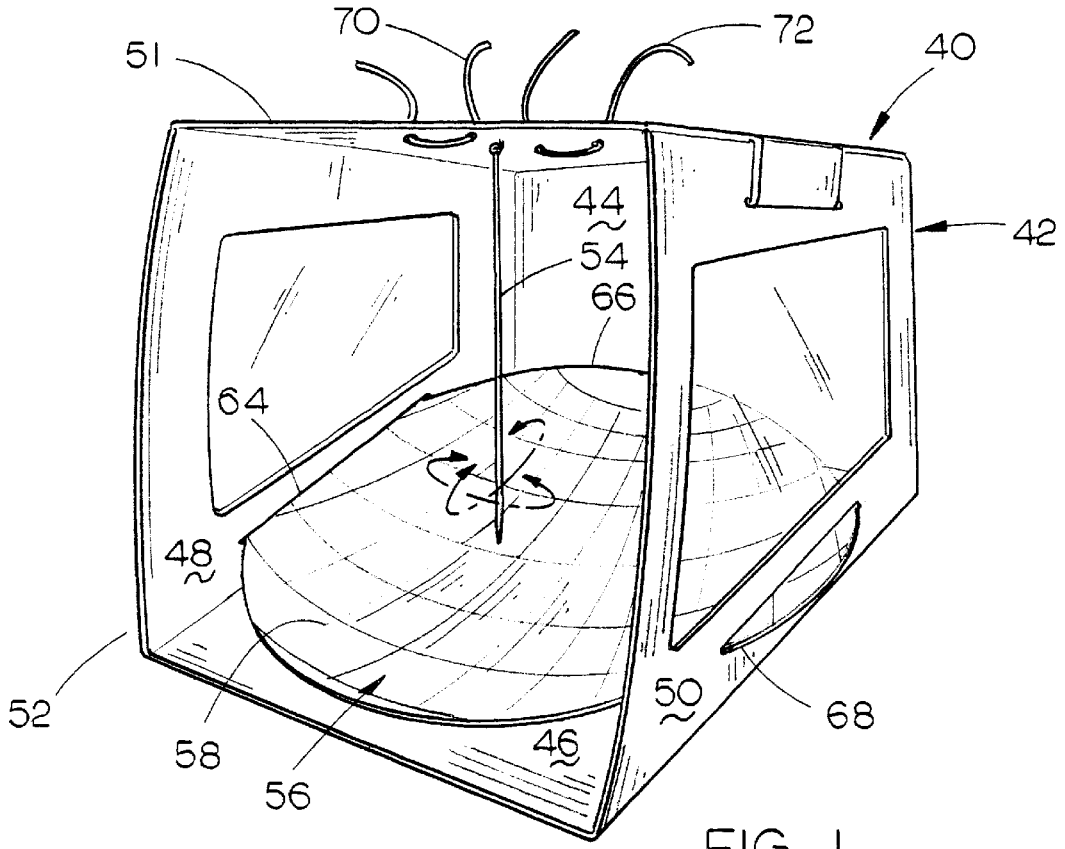
FIG. 1 is a front perspective view of the satellite antenna alignment device of this invention.
Figure 2:
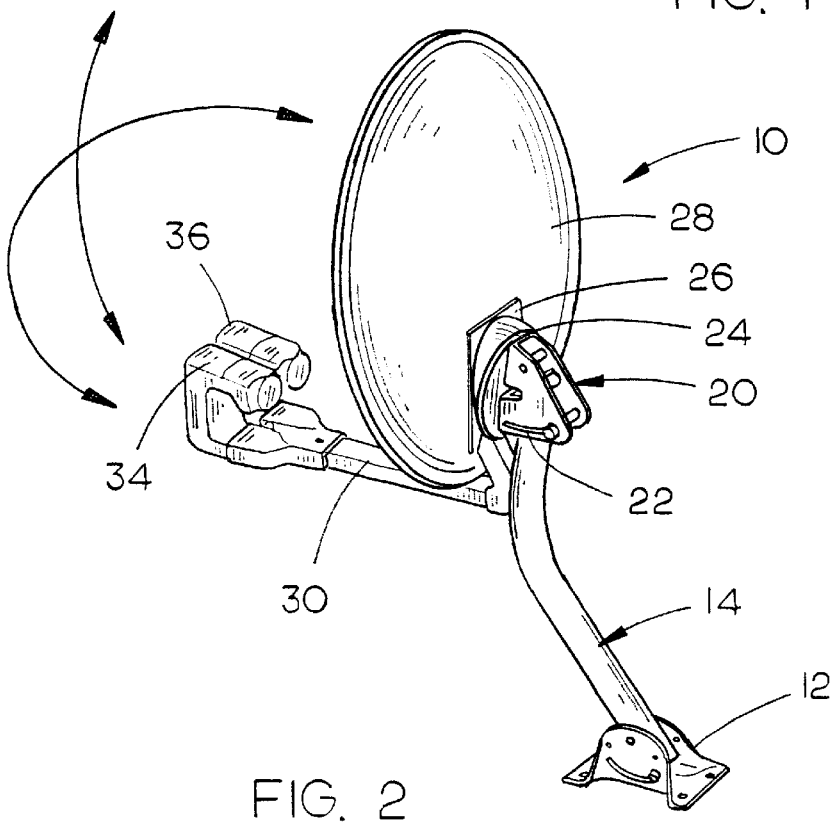
FIG. 2 is a perspective view of a satellite antenna.

The numeral 10 refers to a conventional satellite antenna such as a Dish Network™ 500 antenna. The antenna 10 includes a mounting bracket 12 having a mast 14 pivotally secured thereto and which extends therefrom. The upper end of the mast 14 normally includes a top portion 16 which must normally be disposed as close to vertical as possible. A conventional mast clamp is clamped onto the top portion 16 of the mast 14. A dish mounting bracket 20 is pivotally secured to the mast clamp 16 and includes an elevation scale 22. Dish mounting bracket 20 also includes a skew member 24 which is rotatably secured to the elevation scale 22. Skew portion 24 includes a conventional skew scale. Dish 28 is secured to the bracket member 26 by bolts or the like. Bracket member 26 is secured to skew member 24 for movement therewith. A support arm 30 is operatively secured to the bracket member 26 and extends outwardly from the dish 28, as seen in the drawings. A pair of LNBFs 34 and 36 are mounted on the outer end of the support arm 30. In order for the antenna 10 to receive signals from two satellites, such as those orbiting at one hundred degrees and one hundred ninety degrees west longitude, the mounting bracket 12 is secured to a suitable attachment surface with the top portion 16 of the mast 14 being perfectly vertical. The skew of the antenna is initially set by rotating the dish mounting bracket 20 to align the skew point with the required angle on the skew scale. The elevation of the antenna is set by tilting the dish mounting bracket 20 to align the required angle on the elevation scale. The dish is then secured to the mounting bracket and the mounting bracket is mounted on the mast 14 by means of the mast clamp. The installer then normally attempts, to position the antenna along the correct azimuth. If the upper portion 16 of the mast is not perfectly vertically disposed, the antenna will be improperly aligned. Further, if there is any discrepancy in the elevation adjustment and the skew adjustment, the antenna will not be in alignment. Normally, the signal strength of devices are used to fine-tune the alignment of the antenna. The antenna 10 disclosed herein differs from the antennas described in applicant's earlier patents in that the antenna disclosed herein must be skewed to enable the antenna to receive signals from two satellites. It is for that reason that the invention described herein has been provided.

Figure 3:
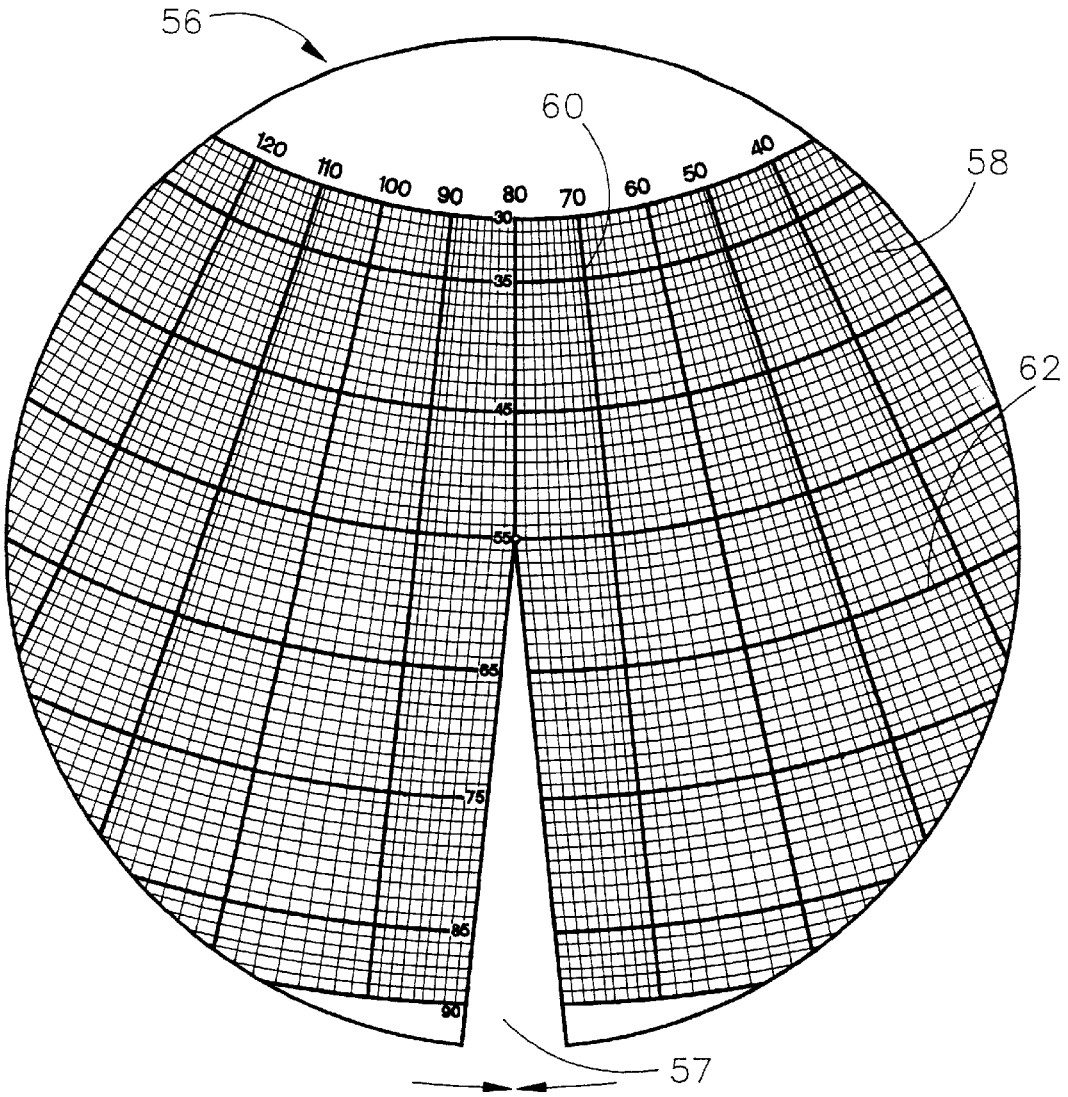
FIG. 3 is a plan view of the chart of the alignment device.
Figure 4:
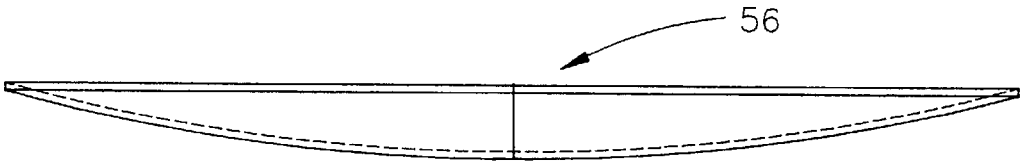
FIG. 4 is an end view of the chart of FIG. 3 with the broken lines illustrating the chart in its operative position.

The satellite antenna alignment device of this invention is referred to generally by the reference number 40. Alignment device 40 includes a housing or support 42 having a back wall 44, bottom wall 46, opposite side walls 48 and 50, and a top wall 51 which define an open outer end 52. Preferably, side walls 48 and 50 are provided With transparent portions to enable the installer to view the interior of the support 42 from either side thereof. Plumb bob 54 has its upper end pivotally secured to the top wall 51 and extends downwardly towards bottom wall 46. The numeral 56 refers to a chart having indicia 58 thereon. Indicia 58 includes generally longitudinally extending lines 60 which represent skew angles. Indicia 58 also includes generally transversely extending lines 62 which represent elevation angles. Although the chart 60 may be flat, it is preferred that it be conical-shaped or parabolic-shaped so that the lower end of the plumb bob 54 will remain substantially constantly spaced from the upper surface of the chart 56 in relatively all positions of the plumb bob with respect to the upper surface of the chart. In order for the chart 56 to assume a parabolic shape, the normally flat chart 56 is provided with a V-shaped slit 57 formed therein, as seen in FIG. 3. When the edges of the slit 57 are joined, the chart 56 becomes parabolic, as seen in FIG. 4. The chart 56 may be mounted within the support 42 by any convenient means, but it is preferred that slits 64, 66 and 68 be provided in side wall 48, back wall 44 and side wall 50 for receiving edges of the chart 56.

Figure 5:
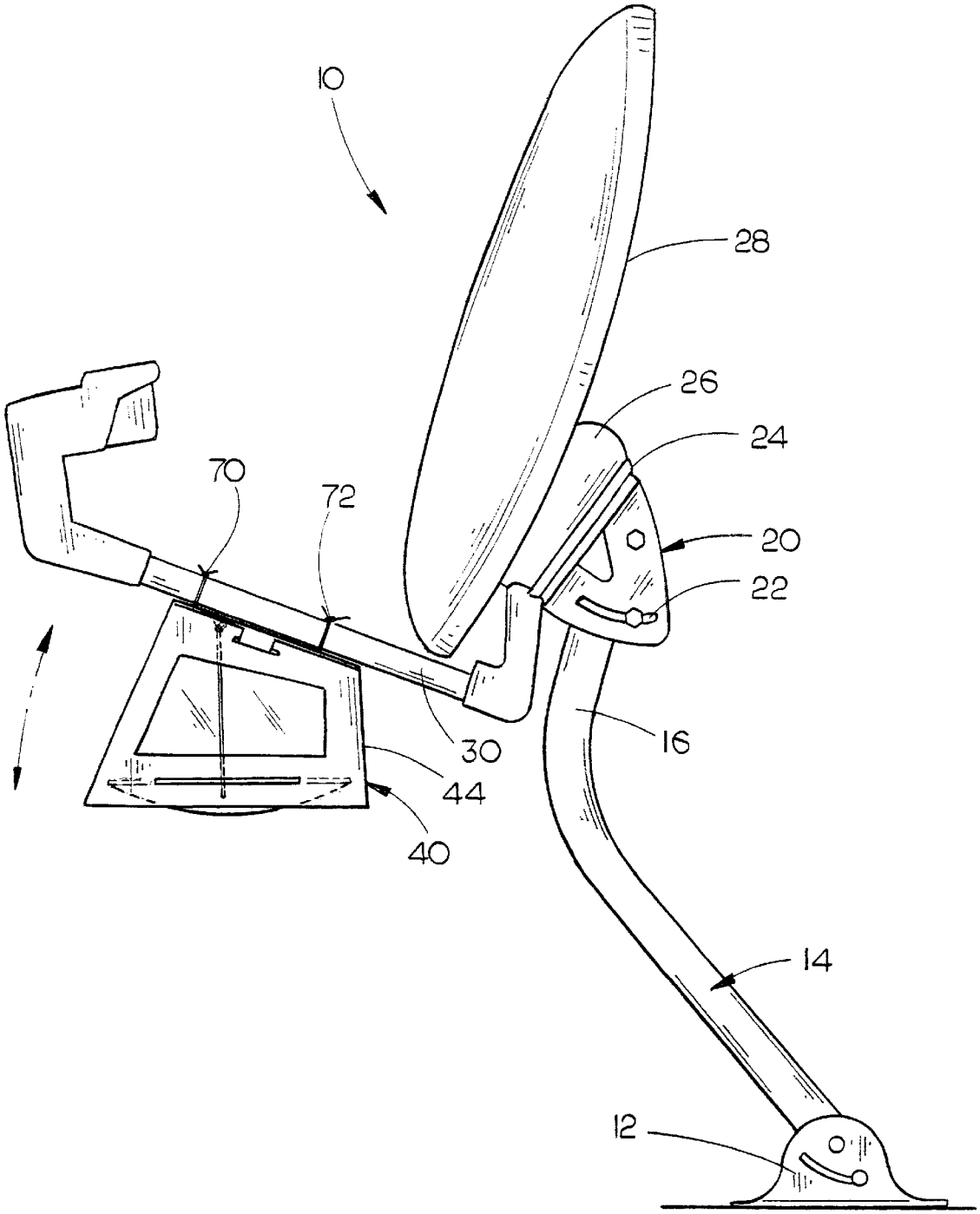
FIG. 5 is a side view of the alignment device of this invention mounted on a satellite antenna.
Figure 6:
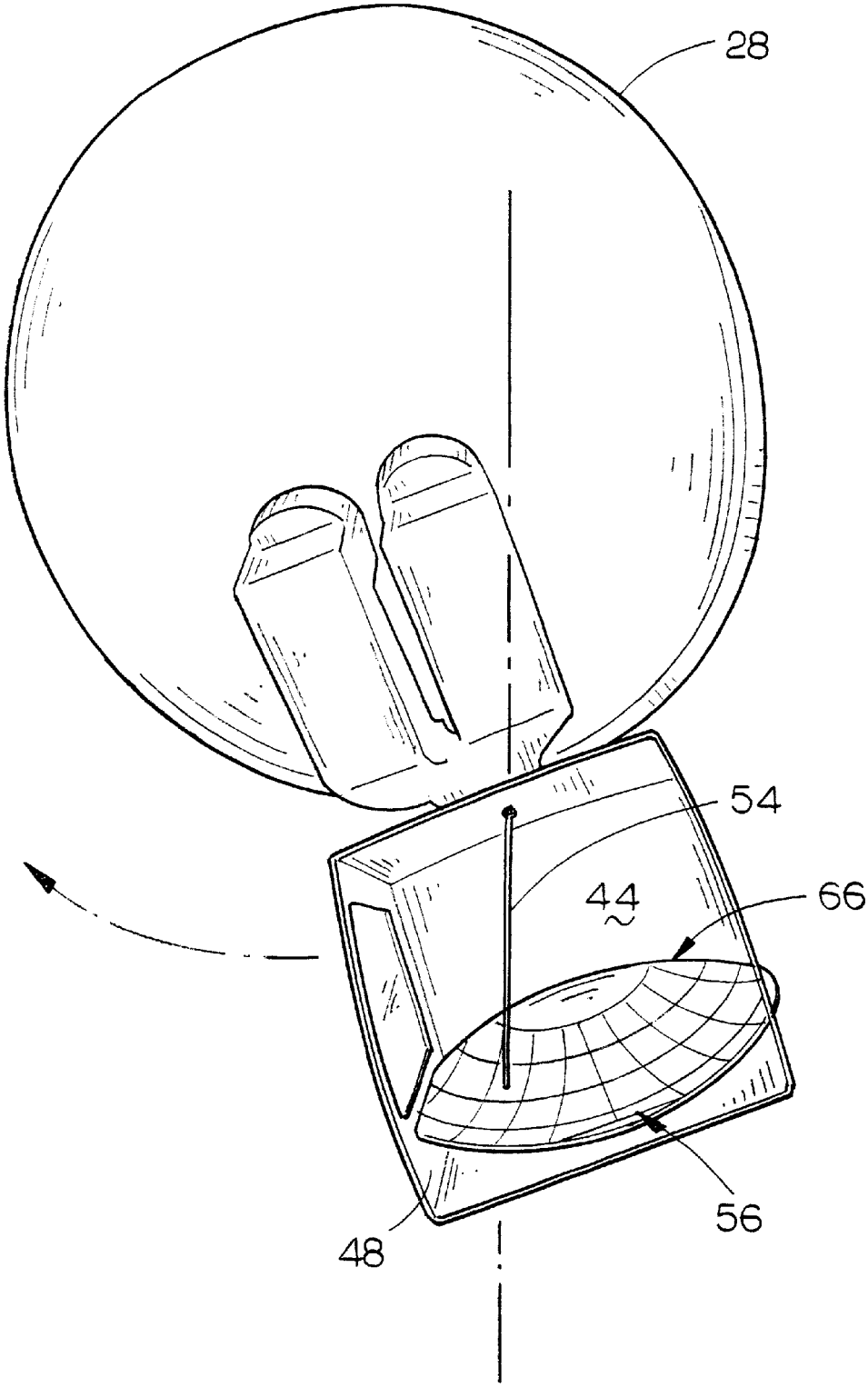
FIG. 6 is a front view illustrating the alignment device of this invention mounted on the antenna.

When the antenna has been pointed along the proper azimuth, the alignment device 40 is used to position the antenna in the proper angle elevation and the proper skew angle. For example, if the antenna is being used in zip code 68124, information provided by the manufacturer of the satellite antenna would indicate that the antenna should be directed along azimuth two hundred and one degrees, elevated to thirty-eight degrees and skewed to one hundred ten degrees. Assuming that the antenna has been directed along azimuth two hundred and one degrees, the installer would place a mark on the chart 56 at the intersection of the elevation angle of thirty-eight degrees and the skew angle of one hundred and ten degrees. The alignment device 40 is then secured to the underside of the support arm of the antenna by any convenient means such as ties 70 and 72, as seen in FIG. 5. Bolts on the mounting bracket would then be loosened so that the support arm could be elevated and skewed until the lower end of the plumb bob is directly positioned over the intersection of the thirty-eight degrees elevation and the one hundred ten degrees skew, as seen in FIG. 6. Bolts on the mounting bracket would then be tightened to maintain the antenna and support arm in that position. The alignment device is then removed for subsequent use.

Figure 7:
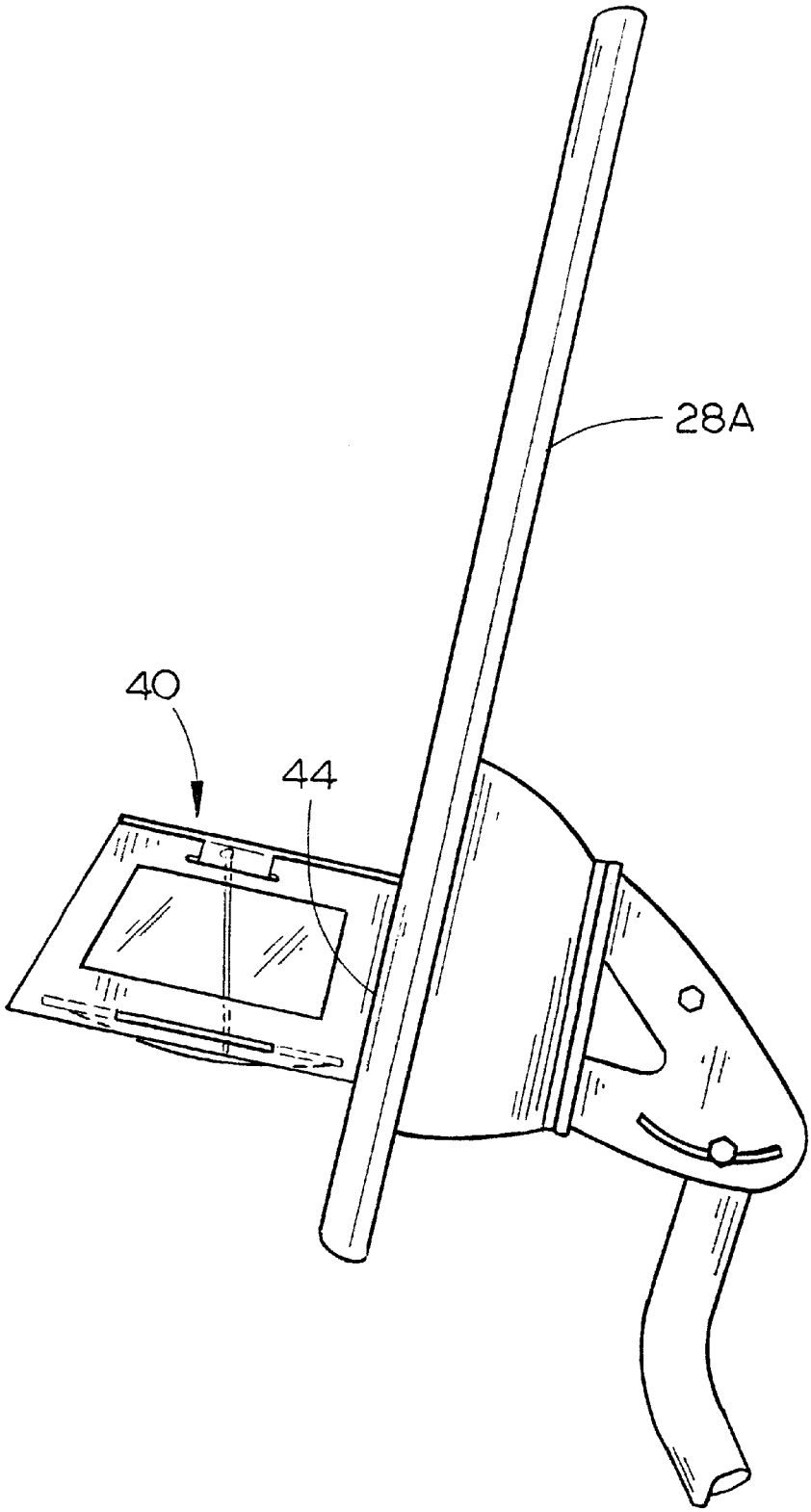
FIG. 7 is a side view of the alignment device being used with a flat dish.

In some instances, the antenna dish may be flat rather than curved. In that case, the rear wall 44 of the device 40 is removably positioned against the flat receiving surface of the antenna dish 28A during the alignment process, as seen in FIG. 7.

Thus it can be seen that a novel antenna alignment device has been provided which enables a satellite antenna to be quickly and easily adjusted for elevation and skew angles without the need for having the top portion of the mast in a perfectly vertically disposed position.

Thus it can been seen that the invention accomplishes at least all of its stated objectives.

I claim:

1. In combination:

a satellite antenna comprising a mast assembly, a dish mounting bracket secured to said mast assembly, a dish mounted on said mounting bracket for movement therewith, said mounting bracket including means for adjusting the elevation and skew of said dish, a support arm secured to said mounting bracket for movement with said mounting bracket and said dish, and at least a pair of amplifiers mounted on said support arm;

and a satellite antenna alignment device adapted to be removably positioned adjacent said support arm;

said satellite antenna alignment device including means for indicating the elevation and skew of the dish.

2. The combination of claim 1 wherein said alignment device includes a support removably fixed to said support arm and wherein said means for indicating the elevation and skew of the dish comprises a vertically disposed plumb bob, having upper and lower ends, said upper end of said plumb bob being pivotally secured to said support, and a chart operatively supported by said support and positioned below the lower end of said plumb bob which indicates elevation and skew angles.

3. In combination:

a satellite antenna comprising a mast assembly, a dish mounting bracket secured to said mast assembly, a dish mounted on said mounting bracket for movement therewith, said mounting bracket including means for at least adjusting the elevation and skew of said dish, a support arm secured to said mounting bracket for movement with said mounting bracket and said dish, at least one amplifier mounted on said support arm;

and a satellite antenna alignment device adapted to be removably positioned adjacent said support arm;

said satellite antenna alignment device including means for indicating the elevation and skew of the dish.

4. The combination of claim 3 wherein said alignment device includes a support removably fixed to said support arm and wherein said means for indicating the elevation and skew of the dish comprises a vertically disposed plumb bob, having upper, and lower ends, said upper end of said plumb bob being pivotally secured to said support, and a chart operatively supported by said support and positioned below the lower end of said plumb bob which indicates elevation and skew angles.

5. In combination with a satellite antenna comprising a mast assembly, a dish mounting bracket secured to said mast assembly, a dish mounted on said mounting bracket for movement therewith, said mounting bracket including means for adjusting the elevation and skew of said dish, a support arm secured to said mounting bracket for movement with said mounting bracket and said dish, at least one amplifier mounted on said support arm, comprising:

a satellite antenna alignment device adapted to be removably positioned adjacent said support arm;

said satellite antenna alignment device including means for indicating the elevation and skew of the dish.

6. The combination of claim 5 wherein said alignment device includes a support removably fixed to said support arm and wherein said means for indicating the elevation and skew of the dish comprises a vertically disposed plumb bob, having upper and lower ends, said upper end of said plumb bob being pivotally secured to said support, and a chart operatively supported by said support and positioned below the lower end of said plumb bob which indicates elevation and skew angles.

7. In combination:

a satellite antenna comprising a mast assembly, a dish mounting bracket secured to said mast assembly, a dish mounted on said mounting bracket for movement therewith, said mounting bracket including means for adjusting at least the elevation and skew of said dish, at least one amplifier operatively secured to said dish;

and a satellite antenna alignment device adapted to be removably positioned adjacent said dish;

said satellite antenna alignment device including means for indicating the elevation and skew of the dish.

8. The combination of claim 7 wherein said alignment device includes a support selectively removably secured to said dish and wherein said means for indicating the elevation and skew of the dish comprises a vertically disposed plumb bob, having upper and lower ends, said upper end of said plumb bob being pivotally secured to said support, and a chart operatively supported by said support and positioned below the lower end of said plumb bob which indicates elevation and skew angles of the dish.

9. In combination:

a satellite antenna comprising a mast assembly, a dish mounting bracket secured to said mast assembly, a dish mounted on said mounting bracket for movement therewith, said mounting bracket including means for adjusting the elevation and skew of said dish, a support arm secured to said mounting bracket for movement with said mounting bracket and said dish, and at least a pair of amplifiers mounted on said support arm;

and a satellite antenna alignment device adapted to be removably positioned adjacent said support arm;

said satellite antenna alignment device including means for indicating the elevation and skew of the dish, and a support removably fixed to said support arm and wherein said means for indicating the elevation and skew of the dish comprises a vertically disposed plumb bob, having upper and lower ends, said upper end of said plumb bob being pivotally secured to said support, and a chart operatively supported by said support and positioned below the lower end of said plumb bob which indicates elevation and skew angles;

said chart being substantially cone-shaped.

10. In combination:

a satellite antenna comprising a mast assembly, a dish mounting bracket secured to said mast assembly, a dish mounted on said mounting bracket for movement therewith, said mounting bracket including means for at least adjusting the elevation and skew of said dish, a support arm secured to said mounting bracket for movement with said mounting bracket and said dish, at least one amplifier mounted on said support arm;

and a satellite antenna alignment device adapted to be removably positioned adjacent said support arm;

said satellite antenna alignment device including means for indicating the elevation and skew of the dish;

said alignment device including a support removably fixed to said support arm and wherein said means for indicating the elevation and skew of the dish comprises a vertically disposed plumb bob, having upper and lower ends, said upper end of said plumb bob being pivotally secured to said support, and a chart operatively supported by said support and positioned below the lower end of said plumb bob which indicates elevation and skew angles;

said chart being substantially cone-shaped.

11. In combination with a satellite antenna comprising a mast assembly, a dish mounting bracket secured to said mast assembly, a dish mounted on said mounting bracket for movement therewith, said mounting bracket including means for adjusting the elevation and skew of said dish, a support arm secured to said mounting bracket for movement with said mounting bracket and said dish, at least one amplifier mounted on said support arm, comprising:

a satellite antenna alignment device adapted to be removably positioned adjacent said support arm;

said satellite antenna alignment device including means for indicating the elevation and skew of the dish;

said alignment device including a support removably fixed to said support arm and wherein said means for indicating the elevation and skew of the dish comprises a vertically disposed plumb bob, having upper and lower ends, said upper end of said plumb bob being pivotally secured to said support, and a chart operatively supported by said support and positioned below the lower end of said plumb bob which indicates elevation and skew angles;

said chart being substantially cone-shaped.

12. In combination:

a satellite antenna comprising a mast assembly, a dish mounting bracket secured to said mast assembly, a dish mounted on said mounting bracket for movement therewith, said mounting bracket including means for adjusting at least the elevation and skew of said dish, at least one amplifier operatively secured to said dish;

and a satellite antenna alignment device adapted to be removably positioned adjacent said dish;

said satellite antenna alignment device including means for indicating the elevation and skew of the dish;

said alignment device including a support selectively removably secured to said dish and wherein said means for indicating the elevation and skew of the dish comprises a vertically disposed plumb bob, having upper and lower ends, said upper end of said plumb bob being pivotally secured to said support, and a chart operatively supported by said support and positioned below the lower end of said plumb bob which indicates elevation and skew angles of the dish;

said chart being substantially cone-shaped.

* * * * *